US007197776B2

(12) United States Patent
Tsai

(10) Patent No.: US 7,197,776 B2
(45) Date of Patent: Apr. 3, 2007

(54) HOLDER DEVICE FOR SHOWER NOZZLE OR THE LIKE

(76) Inventor: Pi Kuang Tsai, 4F-3, No. 73, Sec. 1, Wensin Road, Nantun, Taichung, 408 (TW)

( * ) Notice: Subject to any disclaimer, the term of this patent is extended or adjusted under 35 U.S.C. 154(b) by 357 days.

(21) Appl. No.: 10/940,205

(22) Filed: Sep. 14, 2004

(65) Prior Publication Data

US 2006/0230520 A1 Oct. 19, 2006

(51) Int. Cl.
*A47K 3/28* (2006.01)

(52) U.S. Cl. ..... 4/615; 4/570; 248/230.1; 248/295.11

(58) Field of Classification Search ..... 4/567, 4/568, 570, 605, 615; 248/230.1, 230.2, 248/230.3, 295.11, 297.51, 541
See application file for complete search history.

(56) References Cited

U.S. PATENT DOCUMENTS 2,216,149 A 10/1940 Weiss ..... 248/75
4,461,439 A 7/1984 Rose ..... 248/51
4,546,949 A * 10/1985 Millett et al. ..... 248/230.1 X
6,446,278 B1 9/2002 Lin ..... 4/615
6,671,896 B2 * 1/2004 Tse ..... 4/570
2005/0193487 A1 * 9/2005 Watari ..... 4/570

* cited by examiner

*Primary Examiner*—Robert M. Fetsuga
(74) *Attorney, Agent, or Firm*—Charles E. Baxley

(57) ABSTRACT

A holder device for attaching to a pipe of a shower nozzle includes an attaching device having a hooking member extended from a block for attaching onto the tube, a pipe having an upper portion secured to said block, a seat slidably attached onto the pipe and having a bracket which includes an engaging hole for removeably supporting the shower nozzle. A catching device is disposed in the seat for catching the seat to the pipe, to adjustably support the seat and the shower nozzle to the pipe. A base may include a conduit slidably engaged onto the pipe, and a latch biased to engage with the pipe, to adjustably secure the pipe to the base.

9 Claims, 5 Drawing Sheets

HOLDER DEVICE FOR SHOWER NOZZLE OR THE LIKE

BACKGROUND OF THE INVENTION

1. Field of the Invention

The present invention relates to a holder device, and more particularly to a holder device for adjustably supporting shower nozzles or the like, and for readily attaching to the supporting the surfaces or walls or the like without drilling holes in the supporting surfaces or walls or the like.

2. Description of the Prior Art

Typical holder devices for supporting shower nozzles or other appliances comprise a bracket attached or secured to upper portions of supporting surfaces or walls or the like with fasteners. One or more holes should be drilled into the supporting surfaces or walls or the like with drilling machines or tools, for allowing the fasteners to be threaded into the supporting surfaces or walls or the like.

For example, U.S. Pat. No. 4,461,439 to Rose discloses one of the typical appliance holders including a wall mounted bracket which is required to be attached or secured to the supporting surfaces or walls or the like with fasteners, and one or more holes should also be drilled into the supporting surfaces or walls or the like for threading the fasteners.

However, many families have no drilling machines or tools, and may not easily drilling the holes into the supporting surfaces or walls or the like by themselves, such that the typical appliance holders may not be easily mounted by the users themselves.

U.S. Pat. No. 2,216,149 to Weiss discloses another typical appliance holder including a bracket attached or secured to the supporting surfaces or walls or the like with a suction cup, without drilling holes into the supporting surfaces or walls. However, the suction cups may easily move or slide relative to the supporting surfaces or walls due to the weight of the appliances or the shower nozzles or the like.

U.S. Pat. No. 6,446,278 to Lin discloses a further typical appliance holder including a bracket attached or secured to the supporting surfaces or walls or the like with a stronger sucker member, without drilling holes into the supporting surfaces or walls. However, similarly, after long term of using, the suction cups may also move or slide relative to the supporting surfaces or walls due to the weight of the appliances or the shower nozzles or the like, and due to the frequent attaching or disengaging of the shower nozzles to and from the bracket of the typical appliance holder.

The present invention has arisen to mitigate and/or obviate the afore-described disadvantages of the conventional holder devices.

SUMMARY OF THE INVENTION

The primary objective of the present invention is to provide a holder device for adjustably supporting shower nozzles or the like.

The other objective of the present invention is to provide a holder device for readily attaching to the supporting surfaces or walls or the like without drilling holes in the supporting surfaces or walls or the like.

In accordance with one aspect of the invention, there is provided a holder device for attaching to a pipe, to which a shower nozzle is coupled thereto, said holder device comprising an attaching device including a block, and a hooking member extended from said block, for attaching onto the tube, a pipe including an upper portion secured to said block, a seat slidably attached onto said pipe, and including a bracket extended therefrom and having an engaging hole formed therein for removeably supporting the shower nozzle, and a catching device for catching the seat to the pipe, to adjustably support the seat and the shower nozzle to the pipe.

The block includes two ears extended therefrom and coupled to the hooking member. The attaching device includes a fastener engaged through the ears, to solidly secure the hooking member to the tube.

The block includes a slit formed therein to form two segments. The attaching device includes a fastener engaged through the segments, to solidly secure the tube to the block.

The seat includes a bore formed therein, and an aperture formed through the seat and communicating with the bore of the seat for slidably receiving an intermediate portion of the pipe. The catching device includes a catch slidably received in the bore of the seat and having an opening formed therein for slidably receiving the intermediate portion of the pipe. A spring member is received in the bore of the seat, and engaged with the catch, for biasing the catch against the pipe, and for adjustably securing the pipe to the seat.

A base may further be provided and may include a conduit extended therefrom and having a bore formed therein, and an orifice formed through the conduit and communicating with the bore of the conduit, for slidably receiving the pipe.

The conduit includes a latch slidably received in the bore thereof, and having an opening formed therein for slidably receiving the pipe. A spring member is received in the bore of the conduit, and engaged with the latch, for biasing the latch against the pipe, and for adjustably securing the pipe to the base. The base may include a cup attached thereto for attaching to a supporting surface.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
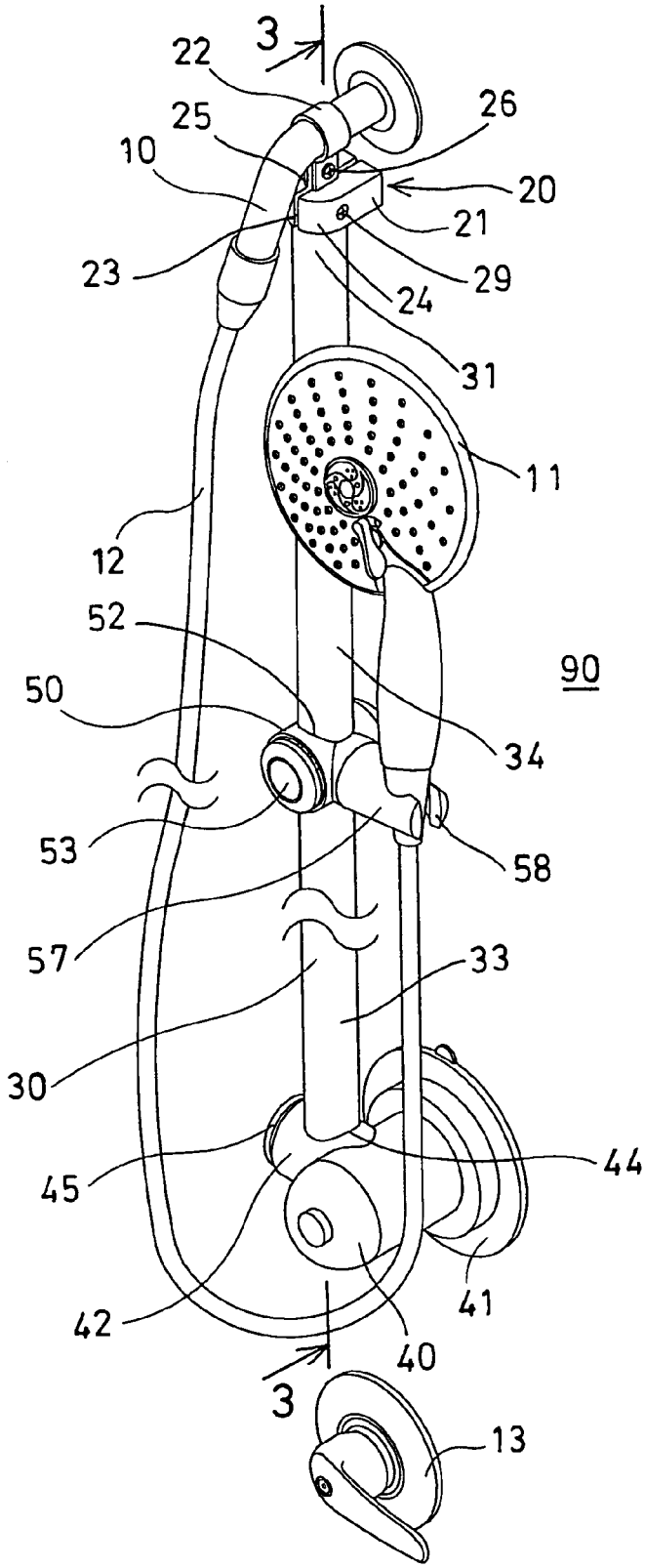
FIG. 1 is a perspective view of a holder device in accordance with the present invention.
Figure 2:
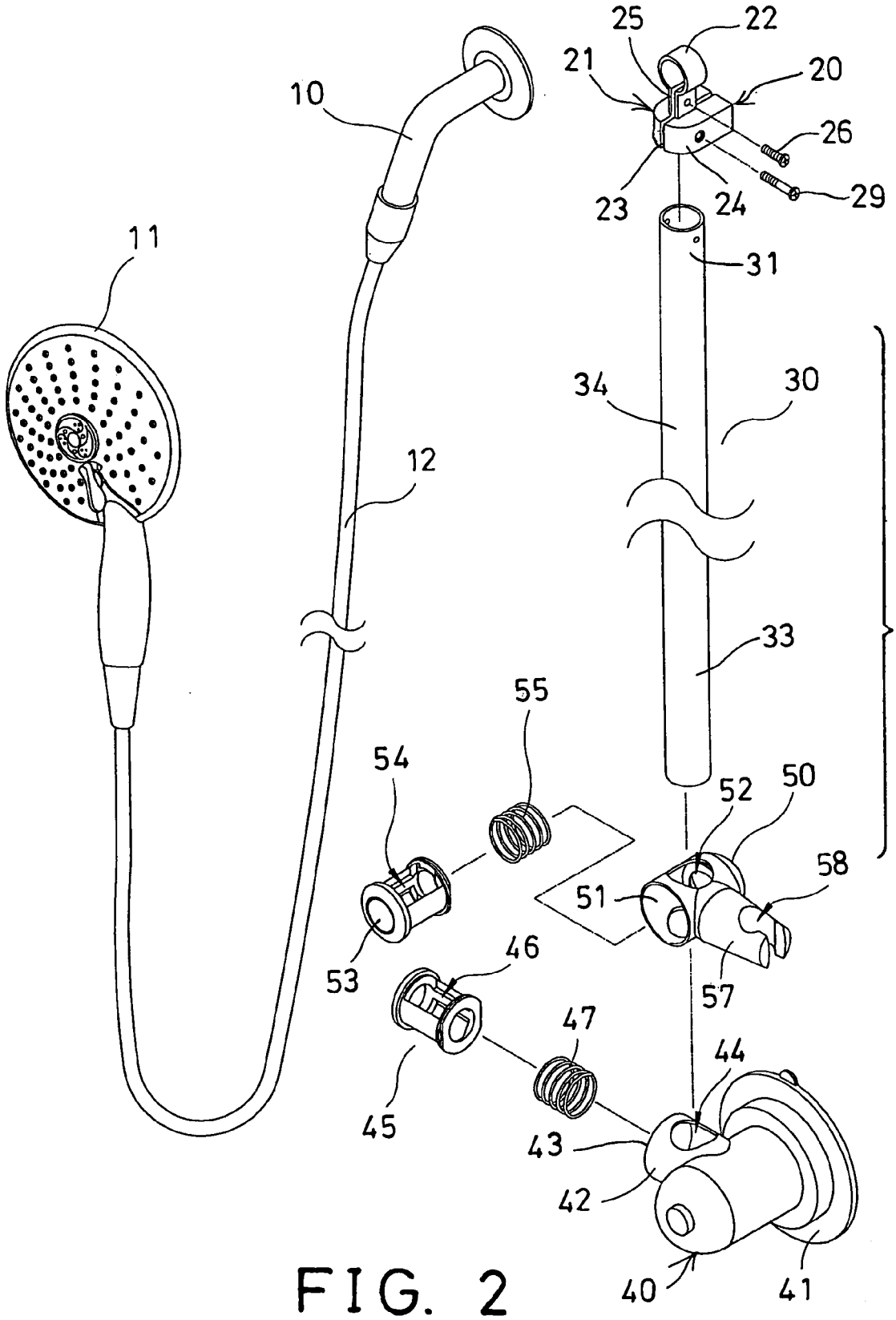
FIG. 2 is an exploded view of the holder device.
Figure 3:
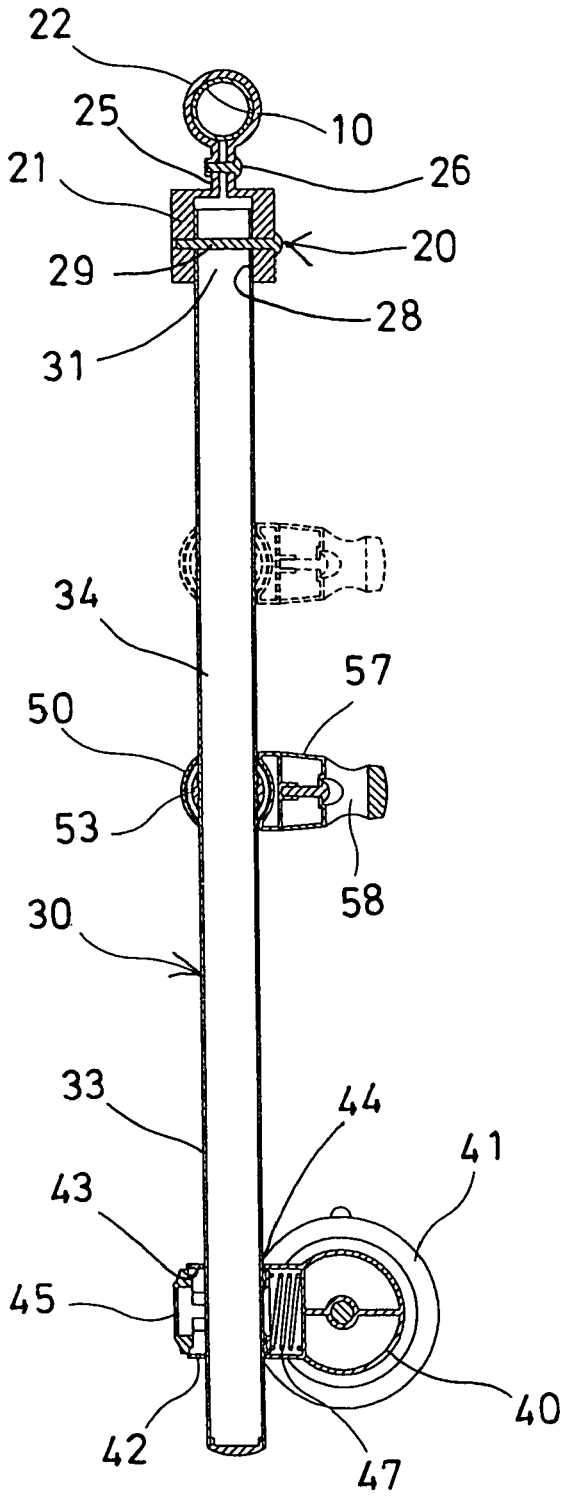
FIG. 3 is a partial cross sectional view of the holder device, taken along lines 3—3 of FIG. 1.

Referring to the drawings, and initially to FIGS. 1–3, a holder device in accordance with the present invention comprises a tube 10 to which a typical shower nozzle 11 is directly attached thereto, or indirectly attached thereto with a hose 12, in which the tube 10 is typically coupled to water reservoirs for supplying water to the shower nozzle 11.

A control device 13 is typically provided and disposed below the tube 10, for controlling hot and/or cold water to flow out through the tube 10. The above-described tube 10 and the shower nozzle 11 and the control device 13 of the holder device are typical and will not be described in further details.

The holder device in accordance with the present invention further comprises an attaching device 20 including a block 21, and a hooking member 22 attached to or extended from the block 21, for hooking or attaching onto the tube 10. It is preferable that the block 21 includes a slit 23 formed therein to form or define two segments 24, and includes two ears 25 extended from the segments 24 respectively, for coupling to or attaching the hooking member 22.

A fastener 26 may further be provided and engaged through the ears 25, to solidly secure the hooking member 22 to the tube 10. The block 21 includes a cavity 28 formed in the lower portion thereof (FIG. 3) for receiving an upper portion 31 of a pipe 30. Another fastener 29 may further be provided and engaged through the segments 24 of the block 21 and the upper portion 31 of the pipe 30, to solidly secure the pipe 30 to the block 21.

Figure 4:
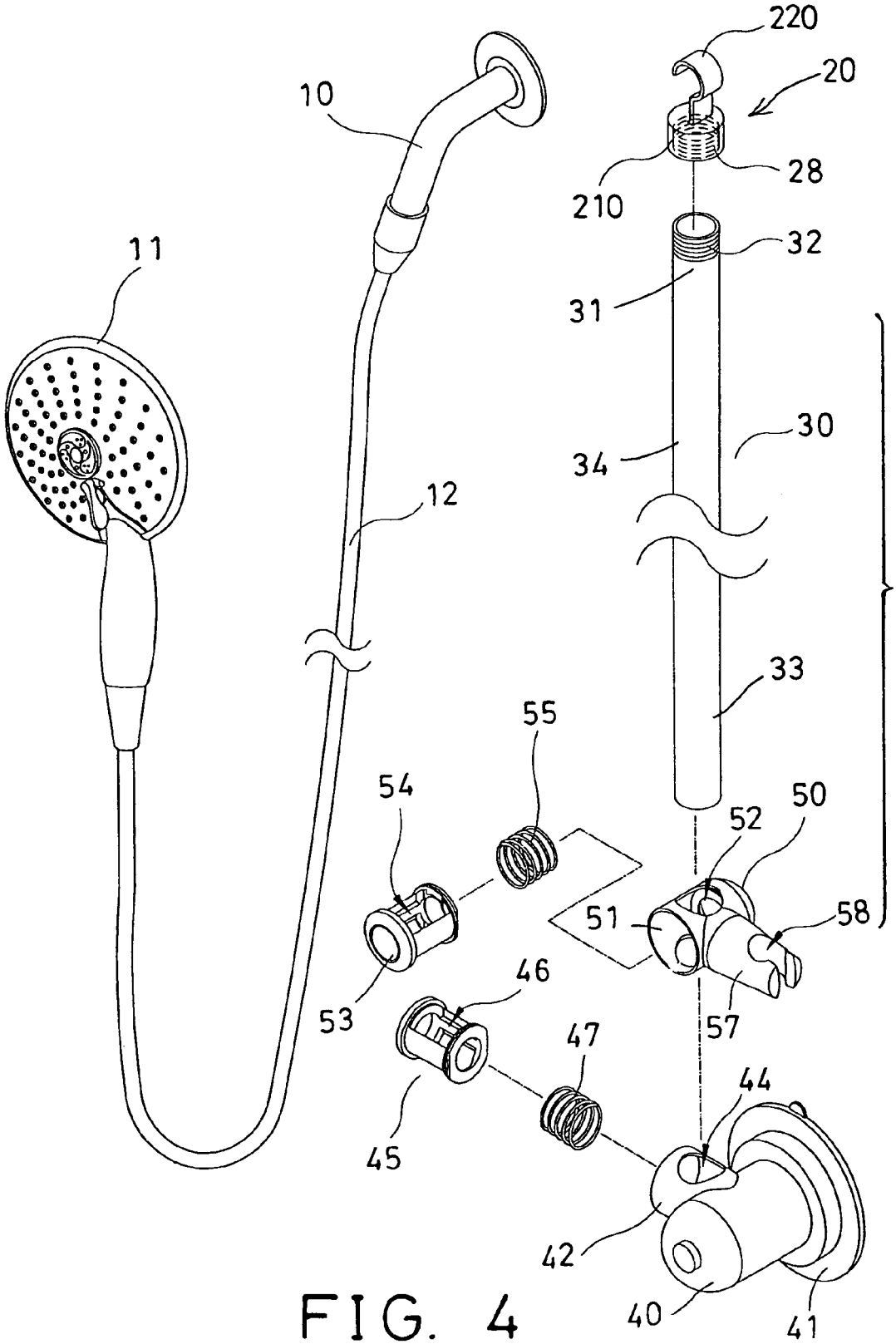
FIG. 4 is an exploded view similar to FIG. 2, illustrating another arrangement of the holder device.

Alternatively, as shown in FIG. 4, the block 210 may include a simple hooking member 220 attached thereto or extended therefrom, for directly hooking or attaching or clamping onto the tube 10. The pipe 30 may be attached or coupled or secured to the block 21 with a threading engagement 32.

Referring again to FIGS. 1–3, a base 40 includes a cup 41 attached thereto for attaching or securing to supporting surfaces 90 or walls or the like with suction forces or with adhesive materials, without fasteners, and includes a conduit 42 laterally extended therefrom and having a bore 43 formed therein, and an orifice 44 formed through the conduit 42 and intersecting or communicating with and/or perpendicular to the bore 43 of the conduit 42, for slidably receiving the lower portion 33 of the pipe 30.

A latch 45 is slidably received in the bore 43 of the conduit 42, and includes an opening 46 formed therein for slidably receiving the lower portion 33 of the pipe 30, and a spring member 47 is also received in the bore 43 of the conduit 42, and engaged with the latch 45, for biasing the latch 45 against the lower portion 33 of the pipe 30, and for adjustably clamping or securing or coupling the lower portion 33 of the pipe 30 to the base 40.

It is preferable that the latch 45 includes a serrated surface or one or more teeth or projections formed therein (not shown), for frictionally engaging with the pipe 30, and for solidly securing the pipe 30 to the base 40. It is to be noted that the upper portion 31 of the pipe 30 may be solidly secured or attached to the tube 10 with the block 21 and the hooking member 22 of the attaching device 20, and the lower portion 33 of the pipe 30 may be coupled to or attached to or positioned to the supporting surfaces 90 with the base 40.

It is further to be noted that the upper portion 31 of the pipe 30 may be solidly secured or attached to the tube 10 with the attaching device 20, such that the weight of the attaching device 20 and the pipe 30 and the base 40 may be sustained by the tube 10 and will not be applied onto the base 40, such that the cup 41 of the base 40 may be used to stably attach or couple or position the pipe 30 and the base 40 to the supporting surfaces 90.

A seat 50 includes a bore 51 formed therein, and an aperture 52 formed through the seat 50 and intersecting or communicating with and/or perpendicular to the bore 51 of the seat 50, for slidably receiving an intermediate portion 34 of the pipe 30. A catching means includes a catch 53 slidably received in the bore 51 of the seat 50, and includes an opening 54 formed in the catch 53 for slidably receiving the intermediate portion 34 of the pipe 30.

A spring member 55 is also received in the bore 51 of the seat 50, and engaged with the catch 53, for biasing the catch 53 against the intermediate portion 34 of the pipe 30, and for adjustably clamping or securing or coupling the intermediate portion 34 of the pipe 30 to the seat 50. It is also preferable that the catch 53 includes a serrated surface or one or more teeth or projections formed therein (not shown), for frictionally engaging with the pipe 30, and for solidly securing the pipe 30 to the seat 50.

The seat 50 includes a bracket 57 attached thereto or extended therefrom and having a key hole or engaging hole 58 formed therein for removeably supporting the shower nozzle 11. It is to be noted that the seat 50 may be easily adjusted along the pipe 30 to various or selected positions, in order to support the shower nozzle 11 at different or various or selected positions of the pipe 30, to allow the shower nozzle 11 to be easily used by adults, children or various people of different sizes or heights.

Figure 5:
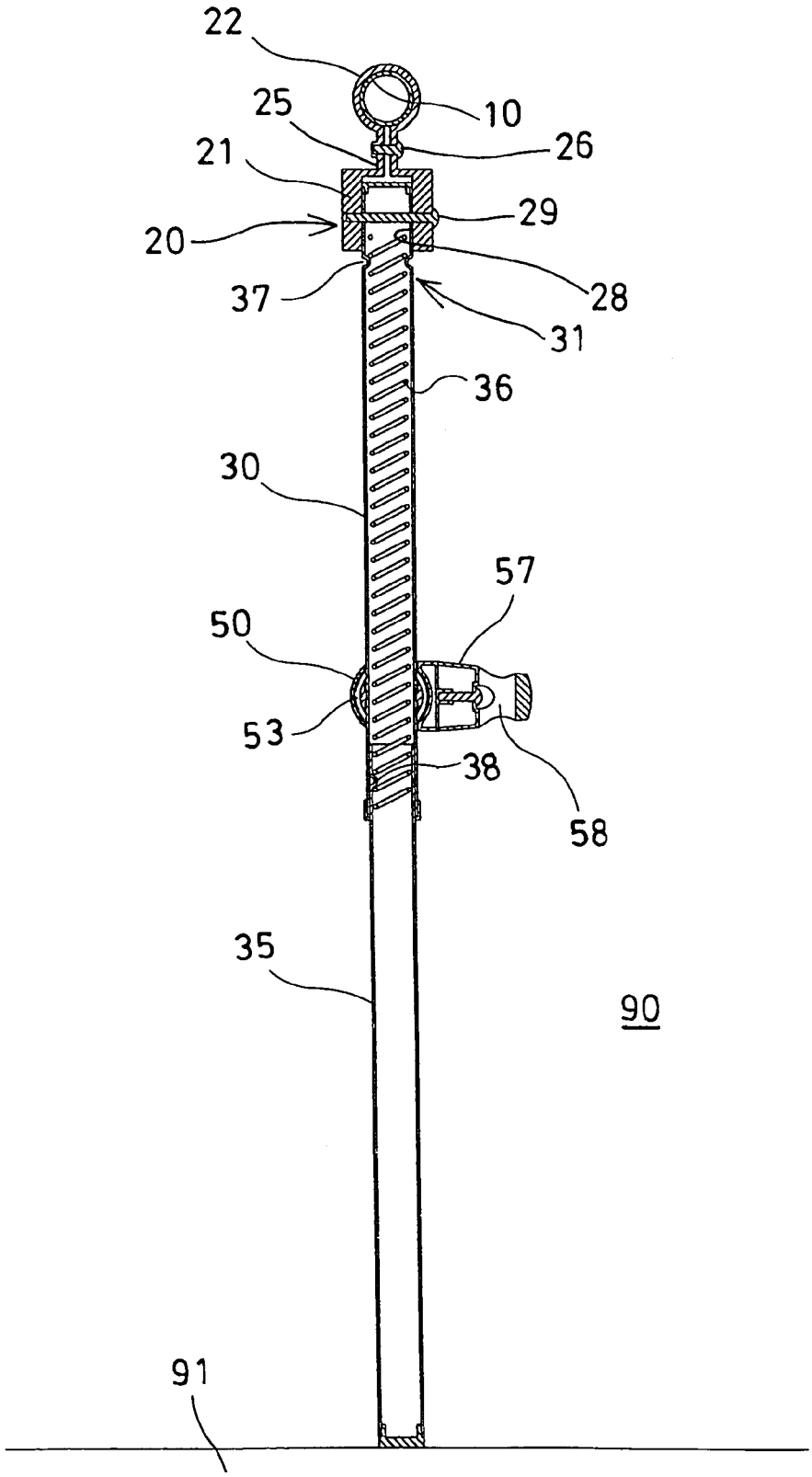
FIG. 5 is a partial cross sectional view similar to FIG. 3, illustrating the other arrangement of the holder device.

Alternatively, as shown in FIG. 5, without the base 40, the pipe 30 may include an extension 35 slidably received in the lower portion thereof, and extendible out therefrom, for engaging with the lower supporting surfaces or ground 91, and a helical spring member 36 is received in the pipe 30. The pipe 30 includes one or more projections 37 extended into the upper portion 31 thereof, and engaged with the spring member 36, to retain the spring member 36 within the pipe 30.

The extension 35 includes a jut 38 extended or provided in the upper portion thereof, and engaged with the helical spring member 36, for allowing the jut 38 of the extension 35 to be threaded or rotated or adjusted relative to or along the helical spring member 36, and for allowing the extension 35 to be threaded or rotated or adjusted relative to the pipe 30 to different height.

In operation, as shown in FIGS. 1–3, the pipe 30 may be solidly attached or secured to the tube 10 with the attaching device 20, such that the weight of the base 40 and the seat 50 and the shower nozzle 11 may all be supported by the tube 10, and such that the weight of the base 40 and the seat 50 and the shower nozzle 11 will not be applied or acted onto the base 40, and such that the cup 41 of the base 40 may be used to stably attach or couple or position the pipe 30 and the base 40 to the supporting surfaces 90.

In addition, the seat 50 may be easily adjusted along the pipe 30 to various or selected positions, such that the shower nozzle 11 may be supported at different or various or selected positions of the pipe 30, to allow the shower nozzle 11 to be easily used by adults, children or various people of different sizes or heights. No holes are required to be drilled into the supporting surfaces or walls or the like, such that the holder device may be easily assembled or mounted by the users themselves.

Accordingly, the holder device in accordance with the present invention may be used for adjustably supporting shower nozzles or the like, and for readily attaching to the supporting surfaces or walls or the like without drilling holes in the supporting surfaces or walls or the like.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A holder device for attaching to a pipe, to which a shower nozzle is coupled thereto, said holder device comprising:

an attaching device including a block, and a hooking member extended from said block, for attaching onto the tube, a pipe including an upper portion secured to said block, a seat slidably attached onto said pipe, and including a bracket extended therefrom and having an engaging hole formed therein for removeably supporting the shower nozzle, and said seat including a bore formed therein and an aperture formed through said seat and communicating with said bore of said seat for slidably receiving an intermediate portion of said pipe, and means for catching said seat to said pipe, to adjustably support said seat and the shower nozzle to said pipe, said catching means including a catch slidably received in said bore of said seat and having an opening formed therein for slidably receiving said intermediate portion of said pipe, and a spring member received in said bore of said seat and engaged with said catch for biasing said catch against said pipe, and for adjustably securing said pipe to said seat.

2. The holder device as claimed in claim 1, wherein said block includes two ears extended therefrom and coupled to said hooking member.

3. The holder device as claimed in claim 2, wherein said attaching device includes a fastener engaged through said ears, to solidly secure said hooking member to the tube.

4. The holder device as claimed in claim 1, wherein said block includes a slit formed therein to form two segments.

5. The holder device as claimed in claim 4, wherein said attaching device includes a fastener engaged through said segments, to solidly secure said tube to said block.

6. The holder device as claimed in claim 1 further comprising a base including a conduit extended therefrom and having a bore formed therein, and an orifice formed through said conduit and communicating with said bore of said conduit, for slidably receiving said pipe.

7. The holder device as claimed in claim 6, wherein said conduit includes a latch slidably received in said bore thereof, and having an opening formed therein for slidably receiving said pipe.

8. The holder device as claimed in claim 6, wherein said base includes a cup attached thereto for attaching to a supporting surface.

9. A holder device for attaching to a pipe, to which a shower nozzle is coupled thereto, said holder device comprising:

an attaching device including a block, and a hooking member extended from said block, for attaching onto the tube, a pipe including an upper portion secured to said block, a seat slidably attached onto said pipe, and including a bracket extended therefrom and having an engaging hole formed therein for removeably supporting the shower nozzle, means for catching said seat to said pipe, to adjustably support said seat and the shower nozzle to said pipe, a base including a conduit extended therefrom and having a bore formed therein, and an orifice formed through said conduit and communicating with said bore of said conduit for slidably receiving said pipe, said conduit including a latch slidably received in said bore thereof and having an opening formed therein for slidably receiving said pipe, and a spring member received in said bore of said conduit, and engaged with said latch, for biasing said latch against said pipe, and for adjustably securing said pipe to said base.

* * * * *